US006465966B2

(12) United States Patent
Konuma

(10) Patent No.: US 6,465,966 B2
(45) Date of Patent: Oct. 15, 2002

(54) FIELD EMISSION DISPLAY AND METHOD OF DRIVING THE SAME

(75) Inventor: Kazuo Konuma, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/767,946

(22) Filed: Jan. 24, 2001

(65) Prior Publication Data

US 2002/0008482 A1 Jan. 24, 2002

(30) Foreign Application Priority Data

Jan. 24, 2000 (JP) ..... 2000-015039

(51) Int. Cl.[7] ..... G09G 3/10

(52) U.S. Cl. ..... 315/169.1; 345/47; 345/204; 345/207; 345/211

(58) Field of Search ..... 315/169.1, 169.2, 315/169.3, 169.4; 345/204, 207, 211, 214, 47, 55

(56) References Cited

U.S. PATENT DOCUMENTS 5,656,892 A * 8/1997 Zimlich et al. ..... 315/169.3
6,060,840 A * 5/2000 Foo et al. ..... 315/169.1
6,204,834 B1 * 3/2001 Baker et al. ..... 315/169.1

* cited by examiner

*Primary Examiner*—Don Wong
*Assistant Examiner*—Thuy Vinh Tran
(74) *Attorney, Agent, or Firm*—Young & Thompson

(57) ABSTRACT

A field emission display includes a cathode panel having an array of electron source units for emitting electrons and a fluorescent panel distanced by a vacuum inter-space from the cathode panel. A cathode panel driver circuit is connected to the field emission display panel for controlling electron emissions from the electron source units. A fluorescent voltage supplying device is connected to the fluorescent panel for supplying a fluorescent voltage to the fluorescent panel. A current measuring device is connected to the fluorescent voltage supplying device for measuring a current value of the fluorescent voltage supplying device. A memory connected to the current measuring device receives a measured current value from the current measuring device and stores the measured current value. A correcting device is connected to the memory for receiving the measured current value for correcting control signals on the basis of the measured current value. The correcting device is also connected to the cathode panel driver circuit for transmitting the corrected control signals to the cathode panel driver circuit.

16 Claims, 14 Drawing Sheets

FIG. 1 prior art

| | K1 | K2 | K3 |
|---|---|---|---|
| G1 | (0,0) | (0,1) | (0,2) |
| G2 | (1,0) | (1,1) | (1,2) |
| G3 | (2,0) | (2,1) | (2,2) |

FED panel array

FED panel array

FED panel array

FED panel array

FIELD EMISSION DISPLAY AND METHOD OF DRIVING THE SAME

BACKGROUND OF THE INVENTION

The present invention relates to a field emission display and a method of driving the same, and more particularly to a field emission display having a memory for storing a current value of a current which flows through a fluorescent power source and a correcting circuit connected to the memory for correcting an output from a cathode panel driver circuit in accordance with the stored current value.

The field emission display has received a great deal of attention as a flat and thickness-reduced advanced display in the next generation. The field emission display is attractive in view of reduced thickness for displaying dynamic images in accordance with picture signals for television broadcastings. The field emission display is attractive in view of reduced manufacturing cost for displaying images in accordance with picture signals from computer as compared to liquid crystal displays. The field emission display comprises a cathode panel for emitting electrons into a vacuum space in accordance with a principle of field emission, and a fluorescent panel for causing luminescence due to excitation energy of the emitted electrons. The above cathode panel faces is separated by a vacuum space from the fluorescent panel. The cathode panel further comprises an array of plural electron source units, each of which is capable of electron emission. The cathode panel is connected to a selecting circuit for selecting one or more electron source units to apply a voltage to the selected electron source units for causing the electron emissions from the selected electron source units. The selecting circuit may be either a simple matrix type wiring or an active matrix type circuit. The fluorescent panel is applied with a positive voltage which is higher than a cathode panel potential of the potential of the electron source units, for example, by about 5V. The above voltage applications cause electron emissions from the electron source units of the cathode panel, and then the emitted electrons are incident into the fluorescent panel, whereby a luminescence is caused on the fluorescent panel to enable the field emission display to display any images.

The field emission display of the simple matrix type has a two-dimensional matrix array of electron source units (0,0), (0,1), (0,2), (1,0), (1,1), (1,2), (2,0), (2,1) and (2,2). FIG. 1 is a diagram illustrative of the two-dimensional matrix array of electron source units of the field emission display of the simple matrix type. Each of the electron source units includes not only the electron source unit provided in the cathode panel but also a fluorescent portion of the fluorescent panel, wherein the fluorescent portion makes a pair with the electron source unit.

FIG. 2 is a timing chart illustrative of driving signals for driving the simple matrix field emission display of FIG. 1. This driving timing chart is in case of pulse width modulation. At a timing "A" in a first frame "F1", electrons are emitted from the three electron source units (0,0), (0,1) and (0,2). Each of the electron source units corresponds to each of pixels. The each pixels comprise micro-chip cathodes. In accordance with the simple matrix field emission display, emitted electrons are then incident into the fluorescent panel, whereby the fluorescent panel shows a luminescence. A brightness of the luminescence depends on an amount of the incident electrons into the fluorescent panel and an applied voltage to the fluorescent panel. The amount of the emitted electrons depends on an applied voltage between a gate electrode and a cathode electrode as well as depends on the field emission structure and material. It is possible that under the same applied voltage condition, the amount of electron emission varies depending upon the structure, material and state of the display surface of the display device. In this case, the display quality in stability is deteriorated.

It has also been known that the carbon nanotube is utilized for the electron source. In this case, electron emission characteristics vary over time. To solve this problem, it is required to increase additional manufacturing processes or to do complicated control methods. This solution methods cause the increase in the manufacturing cost.

In Japanese laid-open patent publication No. 7-57667, a conventional field emission display is disclosed, wherein the number of micro electron emitters and micro electron transmission holes is varied so that a total current of each pixel is almost stable, and the brightness is stable over the entire display surface. The brightness is, however, not stable over time.

Japanese laid-open patent publication No. 8-69746 discloses that a conventional method of forming a field emitter, wherein an inter-electrode film for electron emission is gradually formed under control cased on a measuring result of the field emission characteristics, and an electron source having the field emitter as well as an image creating device. In accordance with this conventional technique, the field emitter is formed which shows the stable electron emission characteristics for obtaining the stability in brightness and providing high quality image. The brightness is, however, not stable over time.

Japanese laid-open patent publication No. 8-248914 discloses a driver circuit for driving the field emitter, wherein a current variation of each pixel of the display is detected to correct video signals for improvement in brightness and providing high quality image. This technique is to control the power source for causing the electron emissions so as to improve the brightness characteristics and provide the high quality image. The necessary control is, however, complicated.

Japanese patent No. 2907080 discloses a conventional field emission display, wherein a resistance layer is formed in series between a cathode wire and an emitter cone for reducing variation in amount of electron emission. This conventional technique is to adjust a resistance value over in-plane positions of the resistance layer connected in series to the cathode electrode for reducing the in-plane unstability in the manufacturing process. After the manufacturing process has been completed, it is difficult to change the resistance value over time.

Japanese laid-open patent publication No. 8-273560 discloses a display and a method of driving the same, wherein a constant current circuit is connected to a cathode electrode for reducing variation in brightness. This conventional technique is to provide the contact current circuit for suppressing the variation in brightness. Parts of the emitted electrodes from the cathode electrode enter into the gate electrode or are involved into a solid creeping conduction, thereby deteriorating the fluorescent current accuracy. This conventional technique is to provide control circuits such as transistors for individual cathode electrodes. This makes the display structure complicated.

Japanese patent No. 2970539 discloses a field emission cathode and a cathode tube using the same, wherein a resistance layer provided to the cathode electrode is formed co-axially around the cathode. This conventional technique is to provide the resistance in series, for which reason it is difficult to change or vary the resistance value after the manufacturing process has been completed.

In the above circumstances, it had been required to develop a novel field emission display having a memory for storing a current value of a current which flows through a fluorescent power source and a correcting circuit connected to the memory for correcting an output from a cathode panel driver circuit in accordance with the stored current value, which is free from the above problem.

SUMMARY OF THE INVENTION

Accordingly, it is an object of the present invention to provide a novel field emission display having a memory for storing a current value of a current which flows through a fluorescent power source and a correcting circuit connected to the memory for correcting an output from a cathode panel driver circuit in accordance with the stored current value, which is free from the above problems.

It is a further object of the present invention to provide a novel field emission display having a memory for storing a current value of a current which flows through a fluorescent power source and a correcting circuit connected to the memory for correcting an output from a cathode panel driver circuit in accordance with the stored current value, wherein the display is capable of realizing a high quality display.

It is a still further object of the present invention to provide a novel method of driving a field emission display having a memory for storing a current value of a current which flows through a fluorescent power source and a correcting circuit connected to the memory for correcting an output from a cathode panel driver circuit in accordance with the stored current value, which is free from the above problems.

It is yet a further object of the present invention to provide a novel method of driving a field emission display having a memory for storing a current value of a current which flows through a fluorescent power source and a correcting circuit connected to the memory for correcting an output from a cathode panel driver circuit in accordance with the stored current value, wherein the display is capable of realizing a high quality display.

The first present invention provides a field emission display comprising: a cathode panel having an array of electron source units for emitting electrons; a fluorescent panel distanced by a vacuum inter-space from the cathode panel; a cathode panel driver circuit being connected to the filed emission display panel for controlling electron emissions from the electron source units; a fluorescent voltage supplying device being connected to the fluorescent panel for supplying a fluorescent voltage to the fluorescent panel; a current measuring device being connected to the fluorescent voltage supplying device for measuring a current value of the fluorescent voltage supplying device; a memory connected to the current measuring device for receiving a measured current value from the current measuring device and storing the measured current value; and a correcting device being connected to the memory for receiving the measured current value for correcting control signals on the basis of the measured current value, and the correcting device being also connected to the cathode panel driver circuit for transmitting the corrected control signals to the cathode panel driver circuit.

The above and other objects, features and advantages of the present invention will be apparent from the following descriptions.

BRIEF DESCRIPTION OF THE DRAWINGS

Preferred embodiments according to the present invention will be described in detail with reference to the accompanying drawings.

FIG. 1 is a diagram illustrative of the two-dimensional matrix array of electron source units of the field emission display of the simple matrix type.

DISCLOSURE OF THE INVENTION

Figure 2:
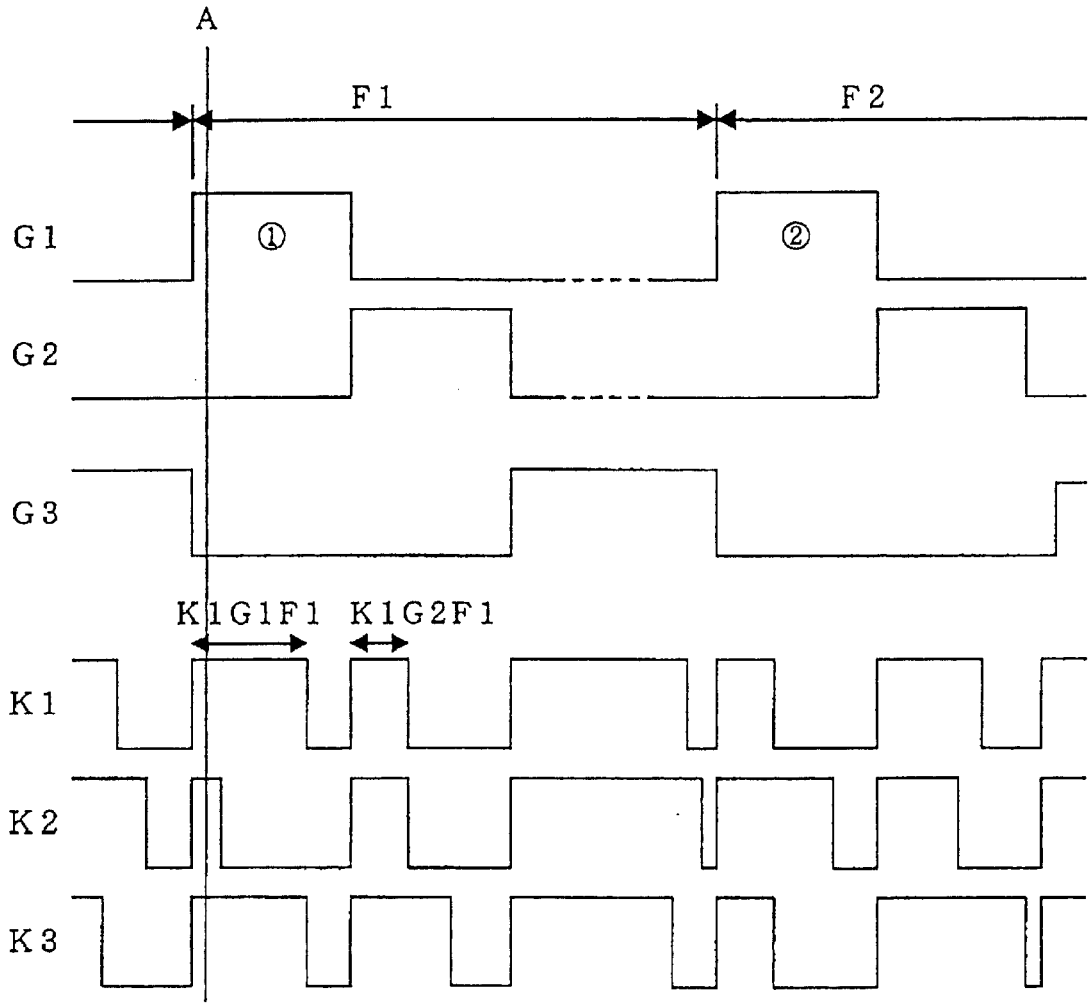
FIG. 2 prior art
FIG. 2 is a timing chart illustrative of driving signals for driving the simple matrix field emission display of FIG. 1.

The first present invention provides a field emission display comprising: a cathode panel having an array of electron source units for emitting electrons; a fluorescent panel distanced by a vacuum inter-space from the cathode panel; a cathode panel driver circuit being connected to the filed emission display panel for controlling electron emissions from the electron source units; a fluorescent voltage supplying device being connected to the fluorescent panel for supplying a fluorescent voltage to the fluorescent panel; a current measuring device being connected to the fluorescent voltage supplying device for measuring a current value of the fluorescent voltage supplying device; a memory connected to the current measuring device for receiving a measured current value from the current measuring device and storing the measured current value; and a correcting device being connected to the memory for receiving the measured current value for correcting control signals on the basis of the measured current value, and the correcting device being also connected to the cathode panel driver circuit for transmitting the corrected control signals to the cathode panel driver circuit.

Even if there are variations in electron emission characteristics over the electron source units, the correcting device and the memory are to compensate the variations on the basis of the measured current value, thereby obtaining high quality and brightness-stable images.

It is preferable that the correcting device comprises a pulse signal converter for transmitting control pulse signals as the control signals, and the pulse signal converter changes at least any one of a pulse height and a pulse width of the control pulse signal on the basis of the measured current value.

It is further preferable that the pulse signal converter transmits a timing pulse to the memory, and the memory stores the measured current value as an information in correspondence with the timing pulse, and the memory transmits the measured current value as a correction data to the pulse signal converter.

It is further more preferable that the fluorescent voltage supplying device temporarily reduces a voltage level of the fluorescent voltage to be supplied to the fluorescent panel, when storing the measured current value into the memory as the information in correspondence with the timing pulse. The reduction in voltage level of the fluorescent voltage causes reduction in velocity energy of electron currents, whereby a luminescent efficiency is also reduced. This prevents the fluorescent material from damage and deterioration and also avoids any excess brightness. It is possible to cause no luminescence in detecting the correction data and also reduce the comsumption power.

It is also preferable that the cathode panel driver circuit drives the cathode panel under the control pulse signal so that electrons are emitted from any one of the electron source units at anytime, when storing the measured current value into the memory as the information in correspondence with the timing pulse. If the electrons are emitted from the plural electron source units concurrently, then the electron emission characteristics from the plural electron source units over the cathode panel are stored in the memory without any complicated operations.

It is also preferable that the cathode panel driver circuit drives the cathode panel under the control pulse signal in a different frame rate from a normal frame rate, when storing the measured current value into the memory as the information in correspondence with the timing pulse. If the frame rate is delayed by 10 times to obtain the information, then it is possible that the frequency characteristics of the current measuring device is also delayed by 10 times. If the frame rate is accelerated by 2 times to obtain the information, then it is possible to obtain double amount of the data in the same time period.

It is also preferable to further comprise a brightness converter connected to the memory for converting the measured current value into a brightness data for subsequent storing the brightness data again in the memory, so that the memory transmits the converted brightness data to the pulse signal converter as the correction data. It is possible to obtain the tri-relationships of the luminescent characteristic, the fluorescent applying current and the control signals to the cathode panel driver circuit, for the purpose of correcting the control signals conveniently and accurately.

It is further preferable that the cathode panel driver circuit drives the cathode panel under the control pulse signal in a different frame rate from a normal frame rate, when storing the brightness data again in the memory. Even if the fluorescent voltage supplying device is changed, then the interrelationships for how much to improve the luminescent efficiency have previously been grasped for conversions into the luminescence amount prior to the storing operation into the frame memory.

It is preferable to further comprise a photo-detector provided at an edge of the fluorescent panel for obtaining the luminescent characteristics. Even if the fluorescent material has been damaged and deteriorated to cause variations in the luminescent characteristics, then the cathode panel is driven under corrected control signals to compensate variations in the luminescent characteristics.

It is also preferable that the current measuring device comprises an ampere meter connected to a lower voltage side of the fluorescent voltage supplying device.

The second present invention provides a method of driving a field emission display comprising: a cathode panel having an array of electron source units for emitting electrons; a fluorescent panel distanced by a vacuum inter-space from the cathode panel; a cathode panel driver circuit being connected to the filed emission display panel for controlling electron emissions from the electron source units; a fluorescent voltage supplying device being connected to the fluorescent panel for supplying a fluorescent voltage to the fluorescent panel; a current measuring device being connected to the fluorescent voltage supplying device; a memory connected to the current measuring device; and a correcting device being connected to the memory, wherein the method comprises the steps of: measuring a current value of the fluorescent voltage supplying device by the current measuring device; storing a measured current value from the current measuring device into the memory; and correcting control signals by the correcting device on the basis of the measured current value, and transmitting the corrected control signals to the cathode panel driver circuit.

Even if there are variations in electron emission characteristics over the electron source units, the correcting device and the memory are to compensate the variations on the basis of the measured current value, thereby obtaining high quality and brightness-stable images.

It is preferable that a pulse signal converter is used as the correcting device for transmitting control pulse signals as the control signals, and changing at least any one of a pulse height and a pulse width of the control pulse signal on the basis of the measured current value.

It is further preferable that a timing pulse is transmitted from the pulse signal converter to the memory for storing the measured current value as an information in correspondence with the timing pulse, and the measured current value as a correction data is transmitted from the memory to the pulse signal converter.

It is further more preferable that the fluorescent voltage supplying device temporarily reduces a voltage level of the fluorescent voltage to be supplied to the fluorescent panel, when storing the measured current value into the memory as the information in correspondence with the timing pulse. The reduction in voltage level of the fluorescent voltage causes reduction in velocity energy of electron currents, whereby a luminescent efficiency is also reduced. This prevents the fluorescent material from damage and deterioration and also avoids any excess brightness. It is possible to cause no luminescence in detecting the correction data and also reduce the comsumption power.

It is also preferable that the cathode panel driver circuit drives the cathode panel under the control pulse signal so that electrons are emitted from any one of the electron source units at anytime, when storing the measured current value into the memory as the information in correspondence with the timing pulse. If the electrons are emitted from the plural electron source units concurrently, then the electron emission characteristics from the plural electron source units over the cathode panel are stored in the memory without any complicated operations.

It is also preferable that the cathode panel driver circuit drives the cathode panel under the control pulse signal in a different frame rate from a normal frame rate, when storing the measured current value into the memory as the information in correspondence with the timing pulse. If the frame rate is delayed by 10 times to obtain the information, then it is possible that the frequency characteristics of the current measuring device is also delayed by 10 times. If the frame rate is accelerated by 2 times to obtain the information, then it is possible to obtain double amount of the data in the same time period.

It is preferable to further comprise the step of converting the measured current value into a brightness data for subsequent storing the brightness data again in the memory, so that the memory transmits the converted brightness data to the pulse signal converter as the correction data. It is possible to obtain the tri-relationships of the luminescent characteristic, the fluorescent applying current and the control signals to the cathode panel driver circuit, for the purpose of correcting the control signals conveniently and accurately.

It is further preferable that the cathode panel driver circuit drives the cathode panel under the control pulse signal in a different frame rate from a normal frame rate, when storing the brightness data again in the memory. Even if the fluorescent voltage supplying device is changed, then the interrelationships for how much to improve the luminescent efficiency have previously been grasped for conversions into the luminescence amount prior to the storing operation into the frame memory.

PREFERRED EMBODIMENT

First Embodiment

Figure 3:
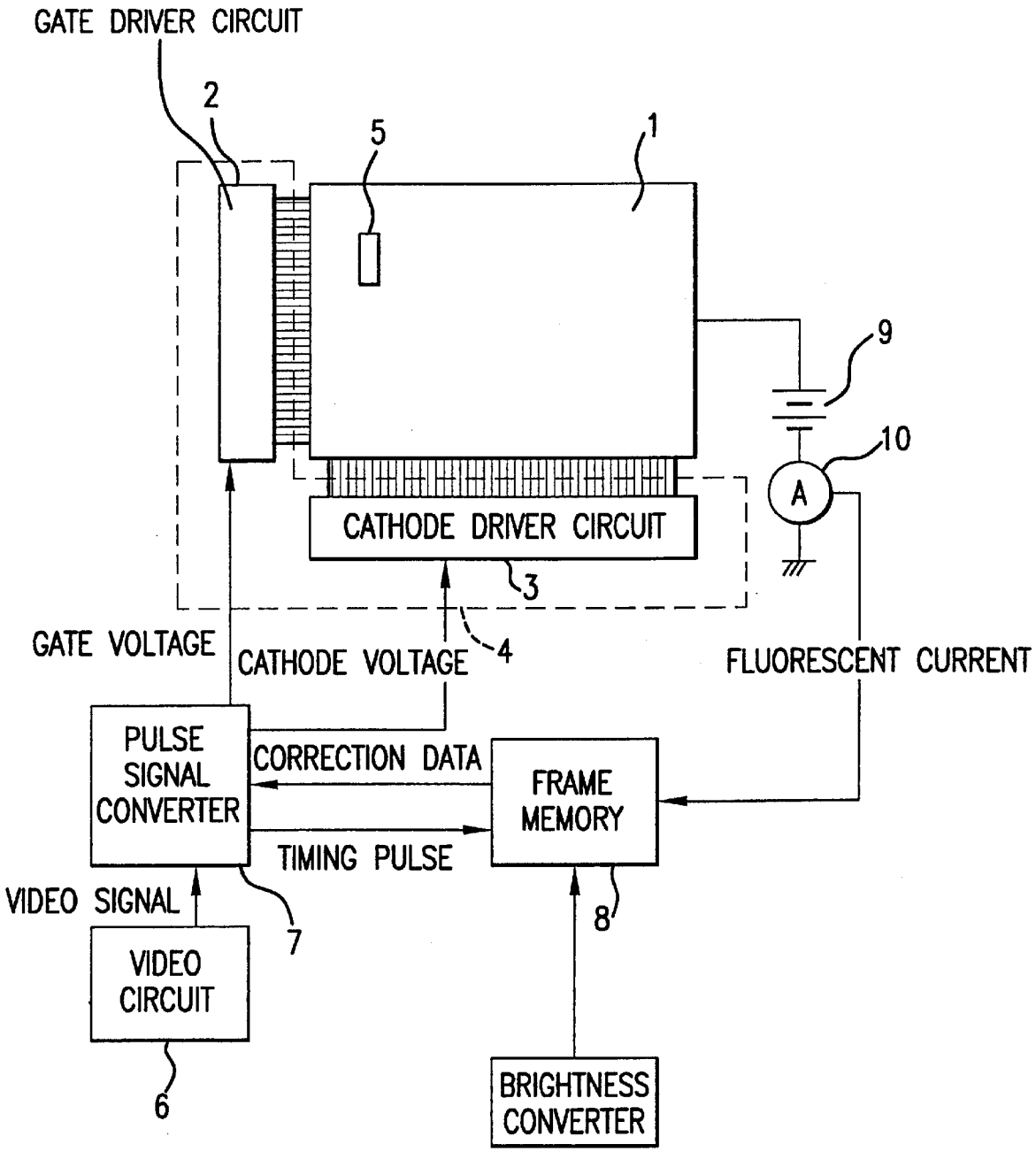
FIG. 3 is a block diagram illustrative of a first novel field emission display in a first embodiment in accordance with the present invention.

A first embodiment according to the present invention will be described in detail with reference to the drawings, wherein a first novel field emission display is provided. FIG. 3 is a block diagram illustrative of a first novel field emission display in a first embodiment in accordance with the present invention. The first novel field emission display has a field emission display panel 1 having a plurality of electron source unit 5, and a cathode panel driver circuit 4. The cathode panel driver circuit 4 includes a gate driver circuit 2 connected with the field emission display panel 1, and a cathode driver circuit 3 connected with the field emission display panel 1. The first novel field emission display further has a fluorescent power source 9 connected to the field emission display panel 1 for applying a high voltage to the fluorescent panel of the field emission display panel 1. The first novel field emission display further more has an ampere meter 10 connected to the fluorescent power source 9 for measuring a fluorescent current of the fluorescent power source 9. The first novel field emission display moreover has a video circuit 6, a pulse signal converter 7 connected to the video circuit 6 for receiving the input of a video signal from the video circuit 6, and a frame memory 8. The pulse signal converter 7 is further connected to the gate driver circuit 2 for supplying a gate-applied voltage information to the gate driver circuit 2. The pulse signal converter 7 is further connected to the cathode driver circuit 3 for supplying a cathode-applied voltage information to the cathode driver circuit 3. The frame memory 8 is connected to the pulse signal converter 7 for receiving a timing-applied voltage from the pulse signal converter 7 and also connected to the ampere meter 10 for receiving a fluorescent current value from the ampere meter 10, so that the frame memory 8 transmits correction data to the pulse signal converter 7.

Figure 4:
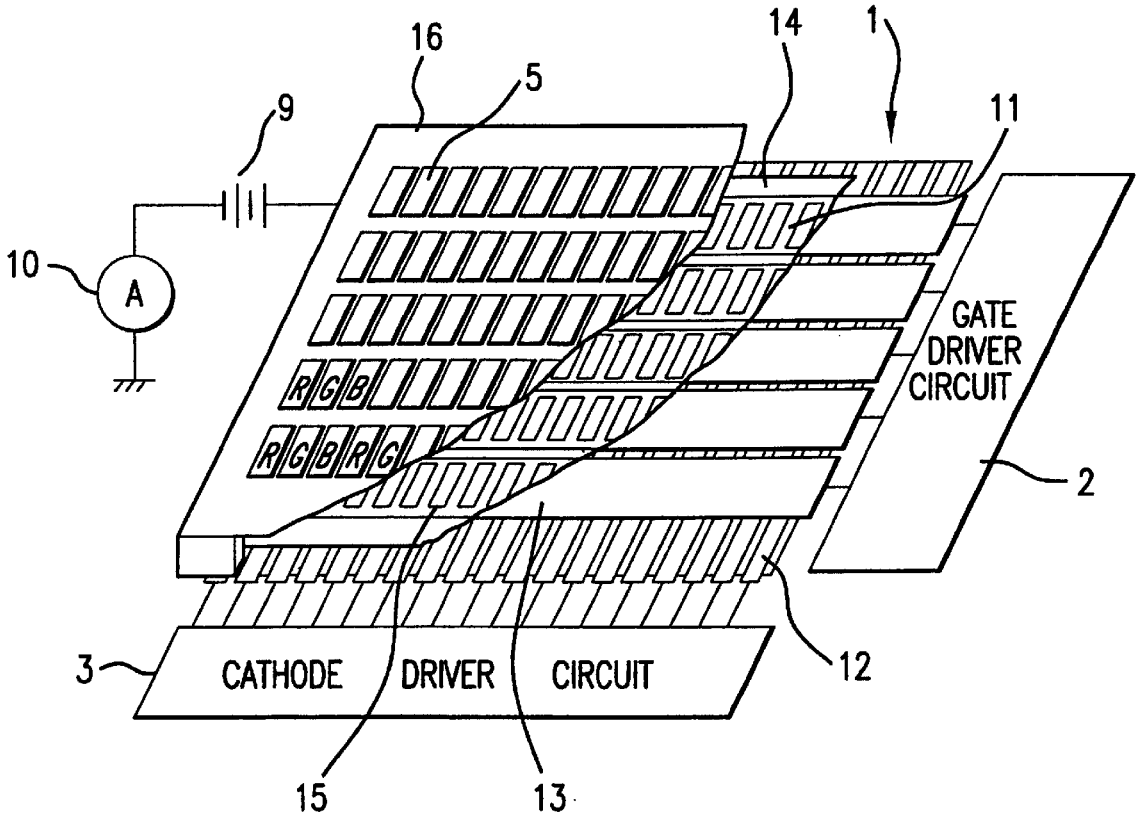
FIG. 4 is a partially-cut schematic perspective view illustrative an internal structure of the field emission display panel of the field emission display of FIG. 3.
Figure 5:
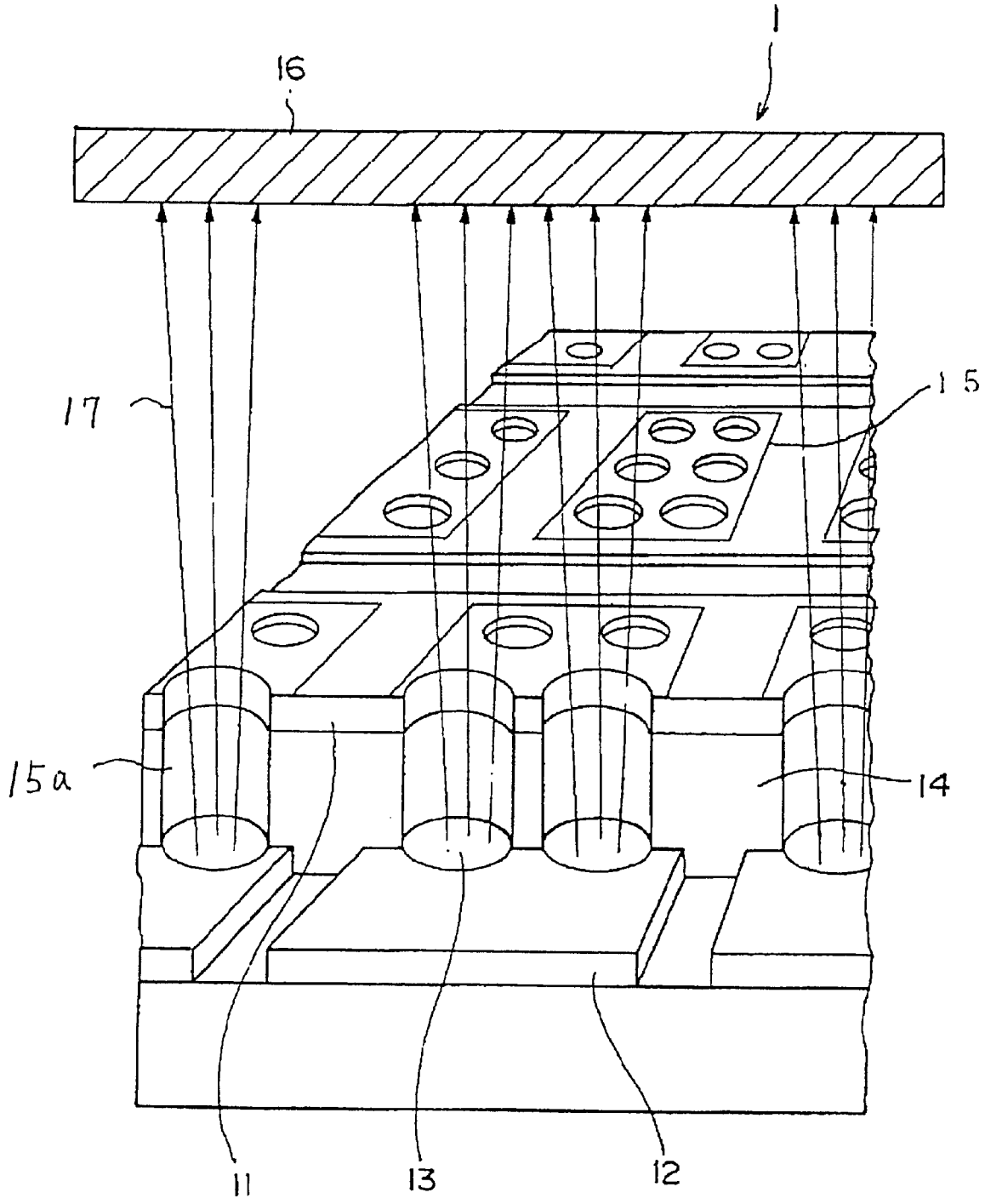
FIG. 5 is a partially-cut fragmentary cross sectional elevation view illustrative an internal structure of the field emission display panel of the field emission display of FIG. 3.

FIG. 4 is a partially-cut schematic perspective view illustrative an internal structure of the field emission display panel of the field emission display of FIG. 3. FIG. 5 is a partially-cut fragmentary cross sectional elevation view illustrative an internal structure of the field emission display panel of the field emission display of FIG. 3. As described above, the field emission display panel 1 is connected to the gate driver circuit 2 and also connected to the cathode driver circuit 3. The field emission display panel 1 is connected to the fluorescent power source 9 which is connected to the ampere meter 10. The field emission display panel 1 further comprises cathode electrodes 12, emitter members 13 overlying the cathode electrodes 12, a gate insulating film 14 overlying the emitter members 13, gate electrodes 11 overlying the gate insulating film 14, and a fluorescent panel 16 overlying the gate electrodes 11. The emitter members 13 are formed in pattern on the surface of the cathode electrodes 12. The emitter members 13 comprise a polyimide paste admixed with carbon nanotubes. The gate insulating film 14 comprises a polyimide paste free of carbon nanotube. The gate insulating film 14 has a thickness of about 5 micrometers. Emitter hole regions 15 are formed in the laminations of the gate insulating film 14 and the gate electrodes 11, wherein the emitter hole regions 15 correspond to the electron source units 5. Each of the emitter hole regions 15 has a plurality of cylindrically shaped emitter holes 15*a*. The fluorescent panel 16 extends in parallel to a cathode panel as a substrate over which the gate electrodes 11 and the cathode electrodes are formed. The fluorescent panel 16 is distanced by about 1 millimeter from the gate electrodes 11 to form an inter-space between the fluorescent panel 16 and the gate electrodes 11. The fluorescent panel 16 has an outside frame member having a height of about 1 millimeter for sealing the vacuum inter-space. Electrons 17 are emitted from the emitter members 13. An amount of the emitted electrons 17 depends on a field of the emitter hole 15*a*, wherein the field is generated by a potential difference between the gate electrode 11 and the cathode electrode 12. The electrons 17 are emitted from the emitter member 13 and travel toward the fluorescent panel 16 applied with the high voltage. Upon incidence of the electrons 17 into the fluorescent panel 16, the fluorescent panel 16 shows the fluorescence.

The fluorescent panel 16 has alternating alignments of red-colored patterns (R), green-colored patterns (G) and blue-colored patterns (B), and a remaining region surrounding the colored patterns, wherein the remaining region is filled with a block matrix of a graphite carbon paste. Each of the colored patterns is included in each of the electron source units 5.

The cathode panel driver circuit 4 is to apply a constant voltage between the gate electrode and the cathode electrode in each of the electron source units of the field emission display panel 1 for a constant time period to cause electron emissions. The gate driving circuit 2 is connected to the gate electrodes 11 whilst the cathode driving circuit 3 is connected to the cathode electrodes 12. The cathode panel driving circuit 4 applies a field emission pulse voltage to intersections which correspond to the selected pixels. The field emission pulse may be a rectangle-shaped pulse, a triangle-shape pulse or a sine-wave pulse. The field emission display panel is connected with the fluorescent power source 9 and the ampere meter 10 connected to the fluorescent power source 9 for measuring the current of the fluorescent power source 9, wherein the ampere meter 10 is provided in a low voltage terminal side of the fluorescent power source 9. The fluorescent power source 9 supplies a high voltage of about 5 kV. The video circuit 6 is to transmit necessary dynamic image data as video signals to the panel signal converter 7, wherein the dynamic image data are for television screens or computer dynamic image data. Upon input of the video signals into the panel signal converter 7, the panel signal converter 7 transmits the timing-applied voltage to the frame memory 8. The frame memory 8 receives the driving timing of the cathode panel driving circuit and the applied voltage information from the pulse signal converter 7, and then receives a measured current value from the ampere meter 10 to store the current value therein. In accordance with the simple matrix driving, the outputs from the ampere meter 10 are stored with conducting a raster scan at a rate of 30 frames per a second. The outputs are stored in the frame memory 8 for every five selected electron source units under the raster scan. The frame memory 8 transmits the correction data for improvement in the display quality such as the brightness to the pulse signal converter 7.

The contents of the correction data will be described in detail. A positive voltage is applied to the fluorescent panel 16 placed facing to a cathode panel as the field emitter, whereby electrons 17 are emitted from the electron source units 5 of the cathode panel and travel toward the fluorescent panel 16. Upon incidence of the electrons 17 into the fluorescent panel 16, the fluorescent panel 16 shows the luminescence, an intensity of which depends upon the incident electron amounts, the voltage applied to the fluorescent panel 16, the fluorescent material, and the structure of the fluorescent panel 16. It is easy possible to know the fluorescent material, and the structure of the fluorescent panel 16. It is easy possible to know the voltage applied to the fluorescent panel 16 by measuring a voltage of an external power source. An irradiated electron amount flows through the power source for applying the power voltage to the fluorescent panel 16, for which reason the irradiated electron amount can be detected by detecting a current of the power source. Thus, a luminescence intensity or amount is presumable from those measurable information.

A subsequent description will focus on the method of recognition to the luminescent position of the screen of the display device. The emission of electrons 17 from the electron source units 5 on the cathode panel are controlled by an output from the cathode driving circuit 3. If the output from the cathode driving circuit 3 is such as applying a higher voltage than a threshold voltage of the field emission to between the gate electrode 11 and the cathode electrode 12 of the selected electron source unit 5 of the cathode panel, then the current from the electron source unit 5 is equal to the current flowing from the power source to the fluorescent panel 16. If the electron emission appears from one of the electron source units 5, then one-to-one correspondence can be established. If, however, the electron emissions appear from a plurality of the electron source units 5, then it is possible to recognize individual electron emission characteristics of the individual electron source units 5. For example, it is considered that the electron emissions appear from the two electron source units. A first voltage between the gate electrode and the cathode electrode of the first one of the two electron source units is fixed or constant, whilst a second voltage between the gate electrode and the cathode electrode of the second one of the two electron source units is varied. An electron emission from the first one of the two electron source units is constant, whilst an electron emission from the second one of the two electron source units is varied depending upon variation in voltage level. The variation in current reads as a current variation of the power source to the fluorescent panel, whereby the electron emission can be measured from the second one of the electron source units. Further, it is possible to recognize the electron emission characteristics of the first one of the electron source units from the difference. As described above, the electron emission characteristics can be recognized in any one of the above available methods.

The recognized information about each of the electron source units 5 are stored in the frame memory 8 and then used for driving the cathode panel to realize the highly accurate image display. In case that the field emission display is used as the video output device, variations in electron emission characteristics of the electron source units make it difficult to display in the expected high quality. It is, however, possible to correct the variations in characteristics of the individual electron source units 5 of the information stored in the frame memory 8. The pulse signal converter 7 transmits, based on the corrected data, the gate voltage application information to the gate driver circuit 2 and also transmits the cathode voltage application information to the cathode driver circuit 3. The pulse signal converter 7 is to correct the driving signals to be transmitted to the cathode panel driver circuit 4.

In accordance with the first novel field emission display, the individual field emission characteristics of the individual electron source units 5 are stored in the frame memory 8 for use of the stored information of the individual field emission characteristics to compensate the variations in the characteristics of the electron source units 5 to obtain the high quality image display even the electron emission characteristics of the electron source units 5 have variations.

Second Embodiment

Figure 6:
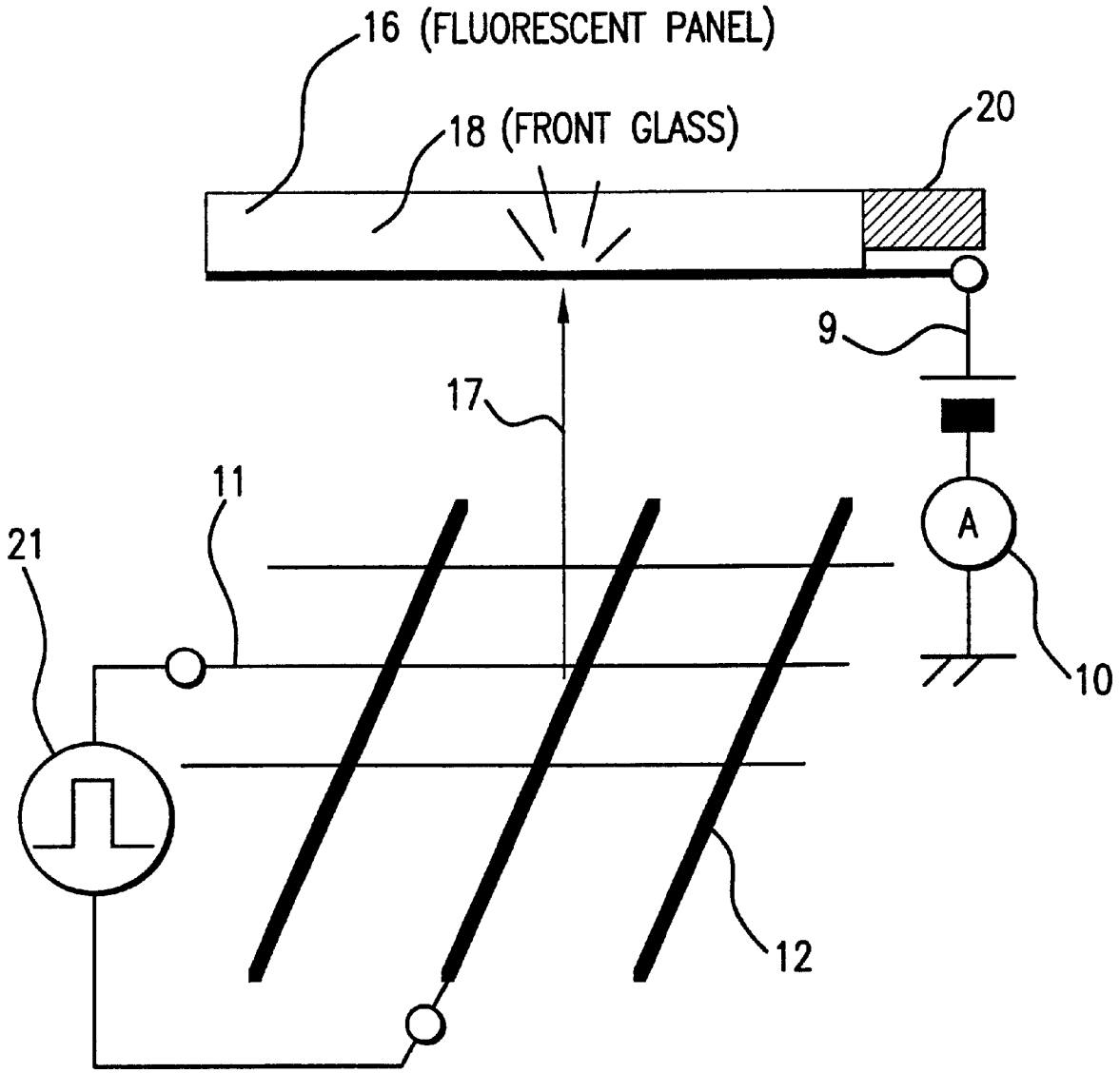
FIG. 6 is a schematic diagram illustrative of a second novel field emission display in a second embodiment in accordance with the present invention.

A second embodiment according to the present invention will be described in detail with reference to the drawings, wherein a second novel field emission display is provided. FIG. 6 is a schematic diagram illustrative of a second novel field emission display in a second embodiment in accordance with the present invention. The second novel field emission display comprises a pulse power source 21 for emitting electrons 17, gate electrodes 11 connected to a first side terminal of the pulse power source 21, cathode electrodes 12 connected to a second side terminal of the pulse power source 21, and a fluorescent panel 16 distanced from the gate electrodes 11 and the cathode electrodes 12. The fluorescent panel 16 has a front glass 18 facing toward an atmosphere, wherein the front glass 18 is positioned in an opposite side to a vacuum inter-space separating the fluorescent panel 16 from the gate electrodes 11 and the cathode electrodes 12. The fluorescent panel 16 also has a photo-detector 20. The fluorescent panel 16 is connected to a fluorescent power source 9 which is further connected to an ampere meter 10. If the electrons 17 are irradiated onto the fluorescent panel 16, then the fluorescent panel 16 shows the luminescence. A part of the luminescence is transmitted through the front glass 18 to eyes of observer. The remaining part of the luminescence is subjected to multiple reflections between the front glass 18 and the surface of the fluorescent material and travels to the edge of the front glass. The multiple-reflected part of the luminescence enters into the photo-detector 20 at the edge of the front glass 18. The photo-detector 20 converts the light into electrical signals. The photo-detector 20 is provided at the edge of the front glass 18 to avoid any disturbance of the image display. The electrons 17 are emitted upon application of the pulse voltage between the gate electrodes 11 and the cathode electrodes 12.

This second novel field emission display is capable of storing the driving pulse voltage, the pulse width, the detection signal from the photo-detector and the current value from the ampere meter for utilizing them as the compensation data.

The second novel field emission display is capable of recognizing the luminescent characteristics on the final stage for highly accurate compensations to the output from the cathode panel driver circuit, wherein the luminescent characteristics involve any variable factors in luminescent characteristics due to deterioration of the fluorescent materials.

Third Embodiment

Figure 7:
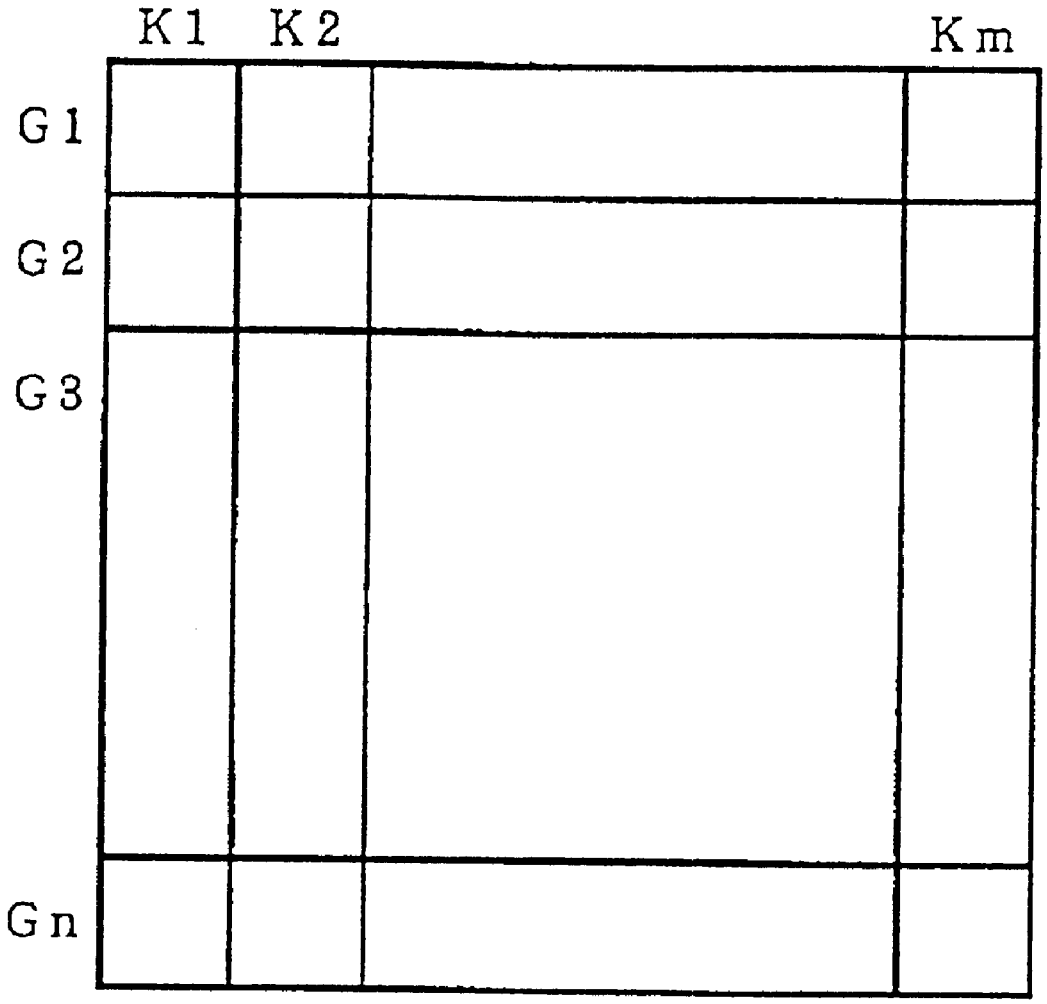
FIG. 7 is a diagram illustrative of a two-dimensional array of electron source units of a field emission display panel for explaining a first novel driving method of driving a field emission display in a third embodiment according to the present invention.
Figure 8:
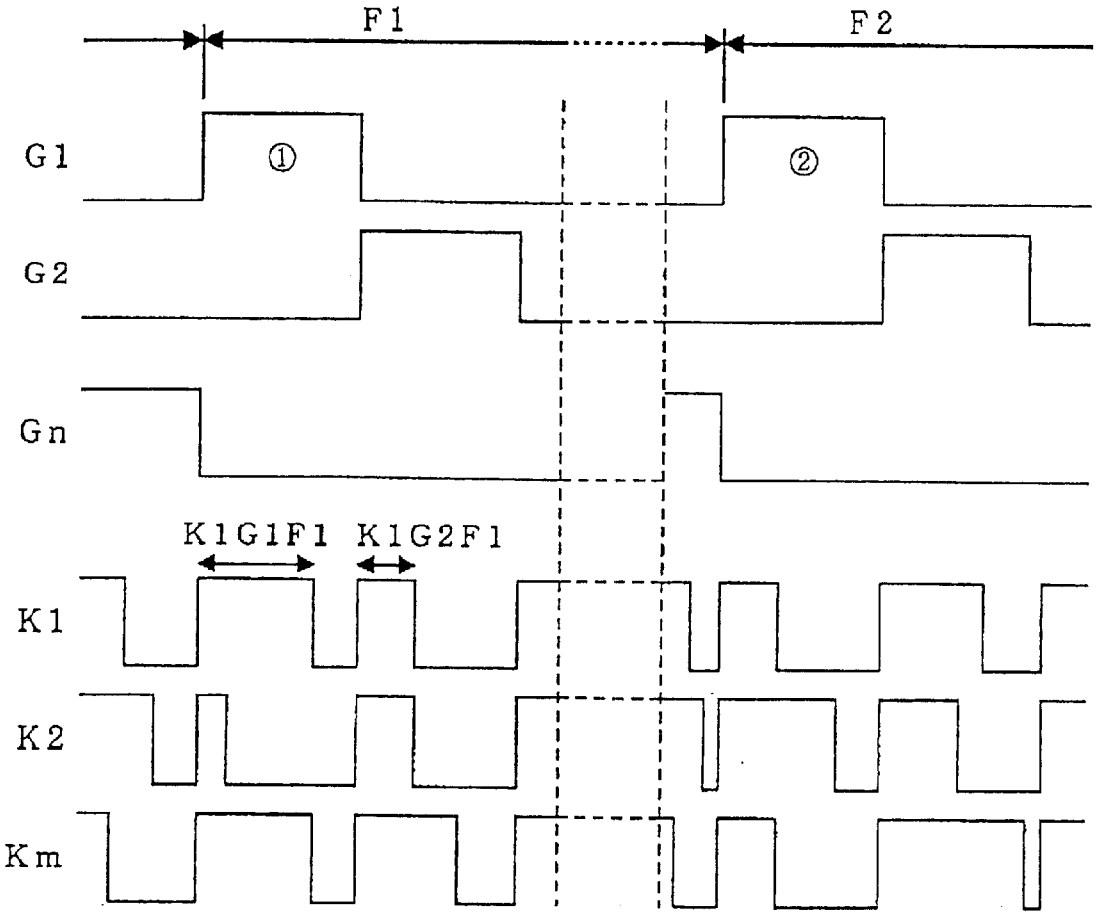
FIG. 8 is a timing chart illustrative of driving signals for driving the two-dimensional array of electron source units of a field emission display panel for explaining a first novel driving method of driving a field emission display in a third embodiment according to the present invention.

A third embodiment according to the present invention will be described in detail with reference to the drawings, wherein a first novel driving method of driving a field emission display is provided. FIG. 7 is a diagram illustrative of a two-dimensional array of electron source units of a field emission display panel for explaining a first novel driving method of driving a field emission display in a third embodiment according to the present invention. FIG. 8 is a timing chart illustrative of driving signals for driving the two-dimensional array of electron source units of a field emission display panel for explaining a first novel driving method of driving a field emission display in a third embodiment according to the present invention. The field emission display panel comprises a two-dimensional array (m×n) of electron source units shown in FIG. 7 and driven by the driver signals of FIG. 8, wherein the timing chart of FIG. 8 is in case of the simple matrix pulse width modulation. Gate electrodes G1, G2, - - - Gn extend in a row direction, whilst cathode electrodes K1, K2, - - - Km extend in a column direction perpendicular to the row direction. A first frame for driving the field emission display panel is so called as a first frame "F1". A second frame for driving the field emission display panel is so called as a second frame "F2". An electron source unit positioned at an intersection of G1 and K1 emits electrons toward the fluorescent panel only in a time period "K1G1F1" in a time period (1) of a high level of G1 in the first frame "F1", and also in a time period "K1G1F2" in a time period (2) of a high level of G1 in the second frame "F2". The emitted electrons are irradiated onto the corresponding electron source unit of the fluorescent panel, whereby the corresponding electron source unit of the fluorescent panel shows the luminescence in the time periods "K1G1F1" and "K1G1F2". In the first frame "F1", the brightness of the electron source unit corresponding to the intersection of G1 and K1 depends upon a potential difference between G1 and K1 and also depends on the electron emission time period "K1G1F1".

If the time period "K1G1F1" is long, then the brightness of the field emission display device is high. However, the current flowing through the fluorescent power source is detected, and then the detected current value is stored in the frame memory as the corresponding information to the timing pulse given from the cathode panel driver circuit, so that on the basis of the current value, at least any one of the applied voltage to the electron source unit and the voltage application time period is modulated. On the basis of information about variations in electron emission characteristics of the individual electron source units, the cathode panel is driven with compensation or correction to obtain the high quality image.

It is preferable that every time when a main power source of the field emission display turns ON, information about variations in electron emission characteristics of the individual electron source units are obtained to renew the currently stored information in the frame memory for further improvement in accuracy of the correction or compensation. In this example, a potential difference between the gate electrode and the cathode electrode is set at 5V which corresponds to a threshold voltage for luminescent which is sensible in a normal luminescent in the room.

The potential difference between the gate electrode and the cathode electrode is kept at 10V for the same time period as the first frame "F1" to allow the electron source units to be 300 cd/m2. For the normal display for the dynamic image, the luminescence is caused at this driving timing to obtain the high quality image.

Fourth Embodiment

Figure 9:
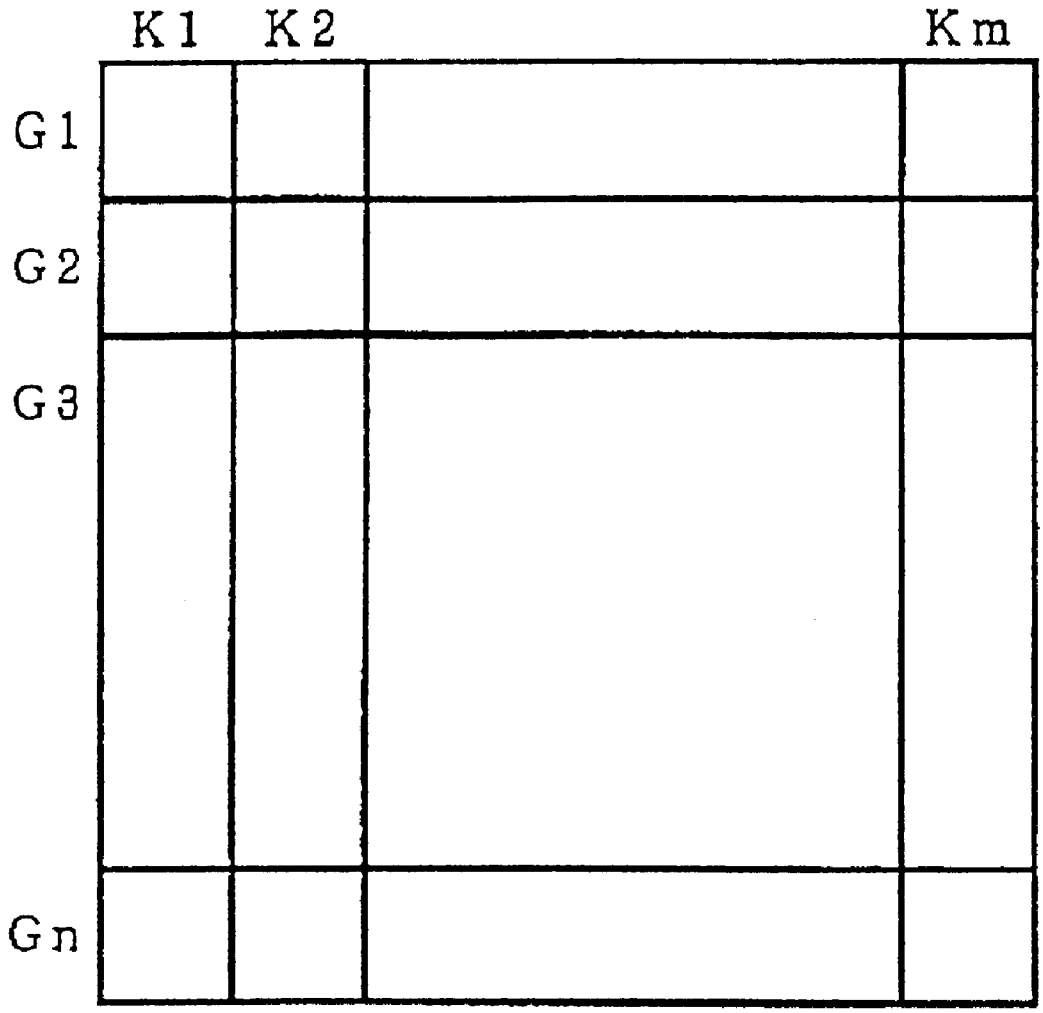
FIG. 9 is a diagram illustrative of a two-dimensional array of electron source units of a field emission display panel for explaining a second novel driving method of driving a field emission display in a fourth embodiment according to the present invention.
Figure 10:
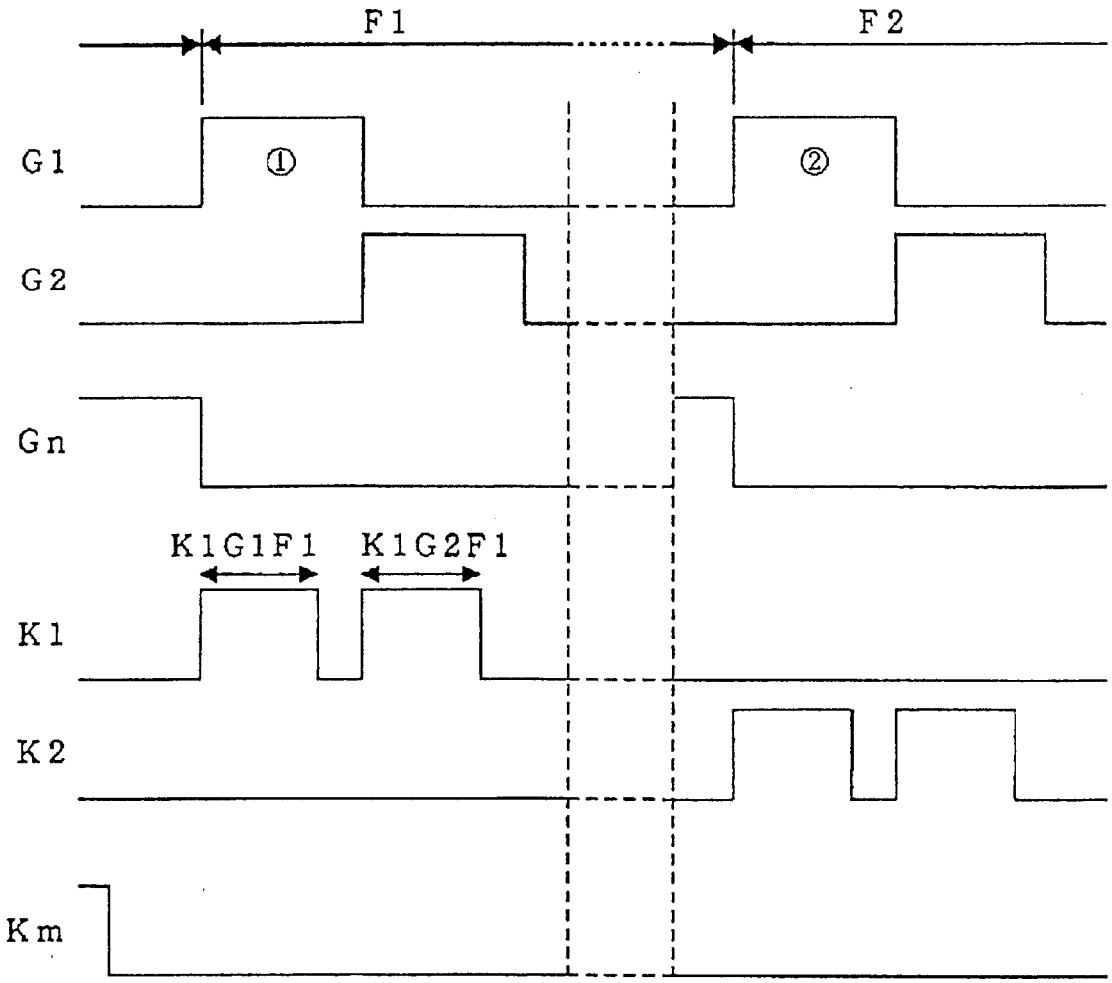
FIG. 10 is a timing chart illustrative of driving signals for driving the two-dimensional array of electron source units of a field emission display panel for explaining a second novel driving method of driving a field emission display in a fourth embodiment according to the present invention.

A fourth embodiment according to the present invention will be described in detail with reference to the drawings, wherein a second novel driving method of driving a field emission display is provided. FIG. 9 is a diagram illustrative of a two-dimensional array of electron source units of a field emission display panel for explaining a second novel driving method of driving a field emission display in a fourth embodiment according to the present invention. FIG. 10 is a timing chart illustrative of driving signals for driving the two-dimensional array of electron source units of a field emission display panel for explaining a second novel driving method of driving a field emission display in a fourth embodiment according to the present invention. The field emission display panel comprises a two-dimensional array (m×n) of electron source units shown in FIG. 9 and driven by the driver signals of FIG. 10, wherein the timing chart of FIG. 10 is in case of specific driving operation for storing electron emission characteristics of the individual electron source units into the frame memory. In the first frame "F1", other cathode electrodes than the cathode electrode "K1" are maintained at 0V. In the second frame "F2", other cathode electrodes than the cathode electrode "K2" are maintained at 0V.

In the time period (1) of the first frame "F1", the electron source unit positioned at the intersection of G1 and K1 shows the luminescence at a brightness which is substantially equivalent to an electron emission in the timer period "K1G1F1" at the potential difference between the gate electrode and the cathode electrode. In the time period (2) of the second frame "F2", the electrons are emitted from the electron source unit at the inter-section of K1 and G2, whereby a fluorescent panel shows the luminescence in the electron source unit.

In the time period (1), the current flowing through the ampere meter 10 becomes a fluorescent panel current which corresponds to the electrons emitted from the electron source unit at the intersection of K1 and G1. On the basis of the timing information obtained from the panel signal converter 7, the frame memory 8 recognizes it to be the time period (1) from the fact that G1 is +5V in the first frame "F1", so that an integrated value of the measured current by the ampere meter 10 in the time period (1) is stored in the electron emission characteristic of the electron source unit "K1G1". Also the voltage between the gate electrode and the cathode electrode and the time period of the voltage application are stored in the frame memory together with the integrated current value.

Some methods of integration of the current values may be available. In case, it is possible to provide the ampere meter with an integration function is placed in the frame memory 8. In other case, it is possible to use a ampere meter capable of sufficiently faster current measurement as compared to the time pried (1) in order to measure an instantaneous current value at a center time of the time period (1) for conducting a rectangle-approximation on the basis of the measured current value, wherein it is assumed that the measured current value is assumed to be fixed in the time period "K1G1F1 ".

In accordance with the above novel method, the electron emission characteristics of the other electron source units are stored in the frame memory. It is assumed that the number of the gate electrodes is "n", and the number of the cathode electrodes "m". In order to obtain the individual electron emission characteristics of all of the electron source units, it is necessary to measure the currents in the time period which corresponds to the "m" frames, whereby each electron emission characteristic data are stored in the frame memory for each of the electron source units. The maximum brightness is scaled at 100%, and it is assumed to drive the field emission display panel at four different brightness levels at 100%, 80%, 50% and 20%. In this case, a longer measurement time period than the above time period by four times is necessary for obtaining the individual electron emission characteristics of all of the electron source units.

The data stored in the frame memory 8 are then used for correction data or compensation data to improve the image re-productivity in the image display operation.

The following descriptions will focus on the methods of how to utilize the correction data for driving the display panel in the "K1G1" electron source unit, wherein the electron emission characteristics data of the "K1G1" electron source unit have been obtained at the four different brightness levels.

In order to obtain 20% brightness level by the pulse width modulation operation from the emission material, it is necessary to apply a voltage of 10V between the gate electrode and the cathode electrode in a time period which corresponds to 15% of the time period (1), and further subject the fluorescent panel to the electron irradiation at 15% of the electron amount necessary for obtaining the 100% brightness. In order to obtain 50% brightness level by the pulse width modulation operation from the emission material, it is necessary to apply a voltage of 10V between the gate electrode and the cathode electrode in a time period which corresponds to 47% of the time period (1), and further subject the fluorescent panel to the electron irradiation at 47% of the electron amount necessary for obtaining the 100% brightness. In order to obtain 80% brightness level by the pulse width modulation operation from the emission material, it is necessary to apply a voltage of 10V between the gate electrode and the cathode electrode in a time period which corresponds to 79% of the time period (1), and further subject the fluorescent panel to the electron irradiation at 79% of the electron amount necessary for obtaining the 100% brightness. In order to obtain 100% brightness level by the pulse width modulation operation from the emission material, it is necessary to apply a voltage of 10V between the gate electrode and the cathode electrode in a time period which corresponds to 100% of the time period (1), and further subject the fluorescent panel to the electron irradiation at 100% of the electron amount necessary for obtaining the 100% brightness. It is convenient for operation to have already prepared a table of the correction data in the function with the secondary function approximation. For example, if the 80% brightness is needed, the time period and the electron amount are corrected to be 79%.

In accordance with the second novel method of driving the field emission display, the current flowing through the fluorescent power source is measured and then stored in the frame memory as the information in correspondence with the timing pulse given from the cathode panel driver circuit, wherein the lower voltage than the normal display state is applied to the fluorescent panel. The other processes and operations than described above are basically identical with what have been described in the above first embodiment. If the lower voltage is applied to the fluorescent panel, a velocity energy of the electron stream is also lower, whereby the luminescent efficiency is also lower. This makes it possible to avoid the fluorescent material from damages and also avoid excess brightness even a relatively large electron current is irradiated. If a further lower voltage is applied to the fluorescent panel, then no luminescence is caused to prevent any unnecessary luminescence in the state of detecting the correction data and also reduce the comsumption power. In the time period of detecting the current value, the voltage level applied to the fluorescent panel is reduced to one half. The reduction in voltage level reduces the velocity energy of the electron current, thereby to reduce the luminescence efficiency. This makes it possible to avoid the fluorescent material from damages and also avoid excess brightness even a relatively large electron current is irradiated. It is possible to prevent any unnecessary luminescence in the state of detecting the correction data and also reduce the comsumption power.

If the luminescence characteristics of the fluorescence panel has a constant threshold voltage to the velocity energy of the electron current, and if the voltage lower than the threshold voltage is applied to the fluorescent panel, then the irradiation of the lower voltage than the threshold voltage to the fluorescent panel causes no luminescence. This prevents any unnecessary luminescence in the state of detecting the correction data and also reduce the comsumption power.

In accordance with the second novel driving method of driving the field emission display, the current values are stored in the frame memory to establish a method of emitting electrons from the single electron source unit at any time. If the electrons are emitted from the plural electron source units, then it is possible to obtain the individual electron emission characteristics of the plural electron source units over the cathode panel without complicated operations.

If the electrons are emitted from the single electron source unit, then the detected current value at any time is derived from the single electron source unit. If, however, the electrons are emitted from the plural electron source units, then it is possible to obtain the individual electron emission characteristics of the plural electron source units over the cathode panel without complicated operations. The data are corrected so that the electron emissions of the each electron source unit are adjusted to desired values to use the corrected data for driving the field emission display.

Fifth Embodiment

Figure 11:
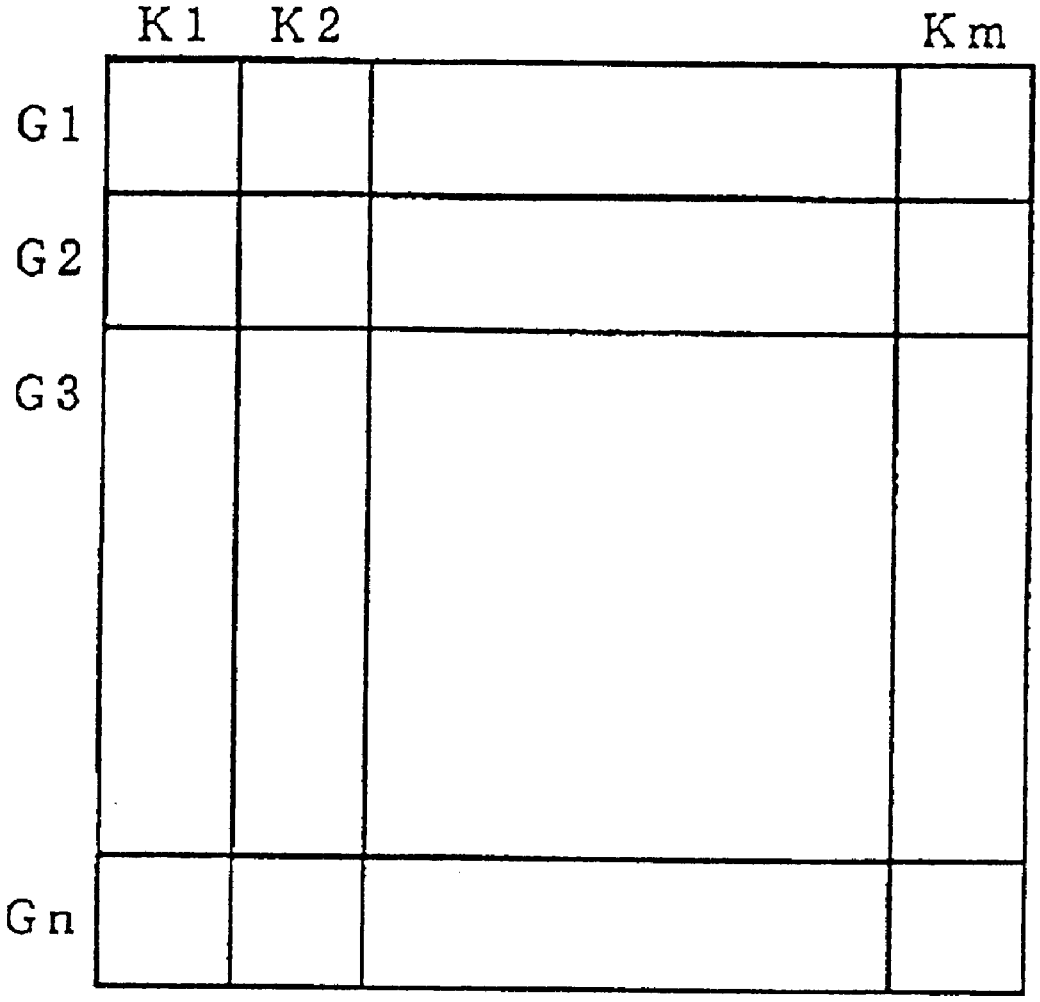
FIG. 11 is a diagram illustrative of a two-dimensional array of electron source units of a field emission display panel for explaining a third novel driving method of driving a field emission display in a fifth embodiment according to the present invention.
Figure 12:
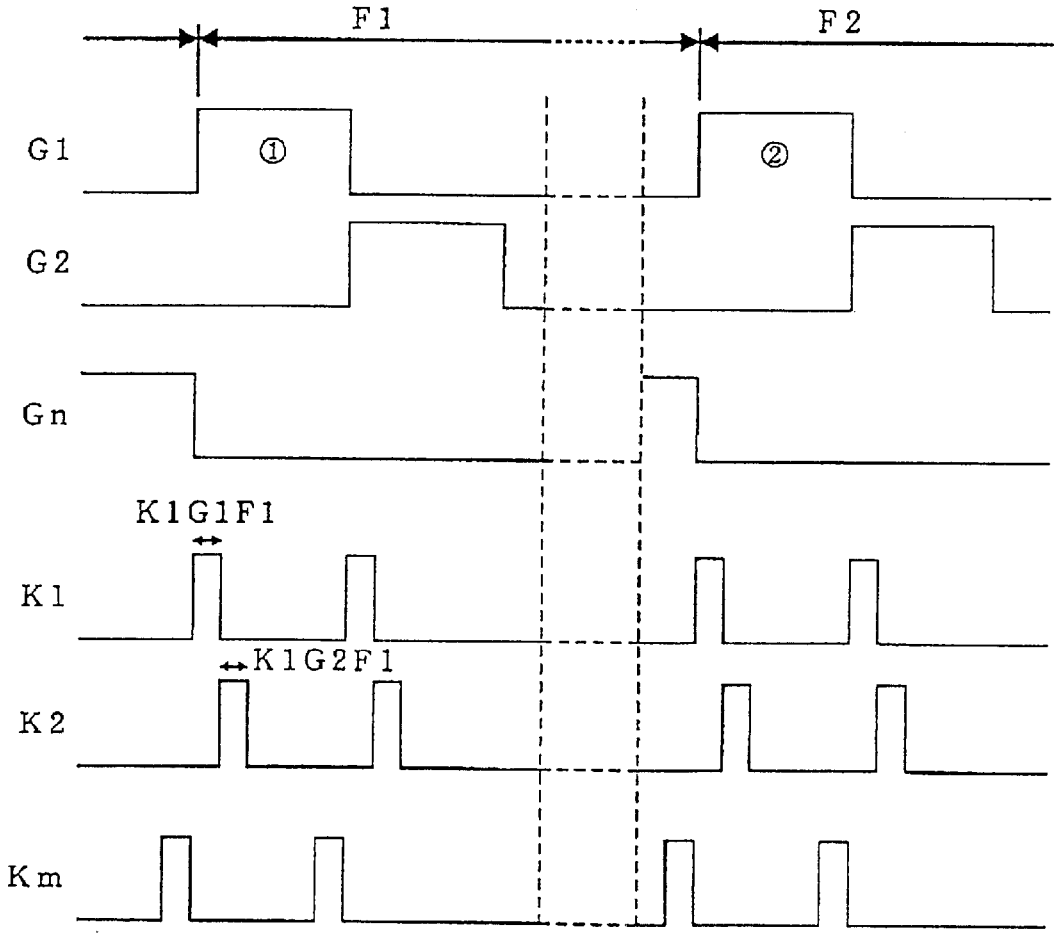
FIG. 12 is a timing chart illustrative of driving signals for driving the two-dimensional array of electron source units of a field emission display panel for explaining a third novel driving method of driving a field emission display in a fifth embodiment according to the present invention.

A fifth embodiment according to the present invention will be described in detail with reference to the drawings, wherein a third novel driving method of driving a field emission display is provided. FIG. 11 is a diagram illustrative of a two-dimensional array of electron source units of a field emission display panel for explaining a third novel driving method of driving a field emission display in a fifth embodiment according to the present invention. FIG. 12 is a timing chart illustrative of driving signals for driving the two-dimensional array of electron source units of a field emission display panel for explaining a third novel driving method of driving a field emission display in a fifth embodiment according to the present invention. The field emission display panel comprises a two-dimensional array (m×n) of electron source units shown in FIG. 11 and driven by the driver signals of FIG. 12, wherein the timing chart of FIG. 12 is in case of specific driving operation for storing electron emission characteristics of the individual electron source units into the frame memory.

The timing chart of FIG. 12 is in the case of driving the simple matrix field emission display in the pulse modulation to obtain the correction data. In case, the first frame "F1" of FIG. 12 is equal to when the normal driving is carried out as shown in FIG. 8 in the above first embodiment. In other case, the first frame "F1" of FIG. 12 is longer by ten times than when the normal driving is carried out as shown in FIG. 8 in the above first embodiment. In the time period (1), G1 is in the high level, wherein a negative voltage is sequentially applied to K1, K2, - - - Km in this order, so that the luminescence is sequentially caused from the most left side and top electron source unit G1K1 to the most right and top electron source unit G1 Km. In the timing chart, one or zero electron source unit shows the electron emission in each time period. The measured fluorescent current from the one electron source can be separated from the other current form the other electron source. In synchronizing with the driving timing, the fluorescent current is measured and the data are stored, whereby the electron emission characteristics in correspondence with the each electron source unit are stored. On the basis of the stored data, the driving pulse width is modulated or corrected in the above manner to obtain the stable display. In FIGS. 2, 8, 10 and 12, the cathode applied voltages K1, K2 - - - Km are negative pulse voltages, wherein upward direction represents the negative polarity.

In accordance with the novel driving method of driving the field emission display, the driving operation is carried out in a different frame rate from the normal display state for storing the data into the frame memory. The other operations and processes than described above are basically identical with what have been described in the above first embodiment.

If it is necessary to obtain information with ten times delays of the frame rate from the normal timing, then the frequency characteristic of the current detector is delayed by ten times to enable an inexpensive current detector to measure the current at high accuracy. If the frame rate is increased two times, then double data can be obtained in the same time period.

Sixth Embodiment

Figure 13:
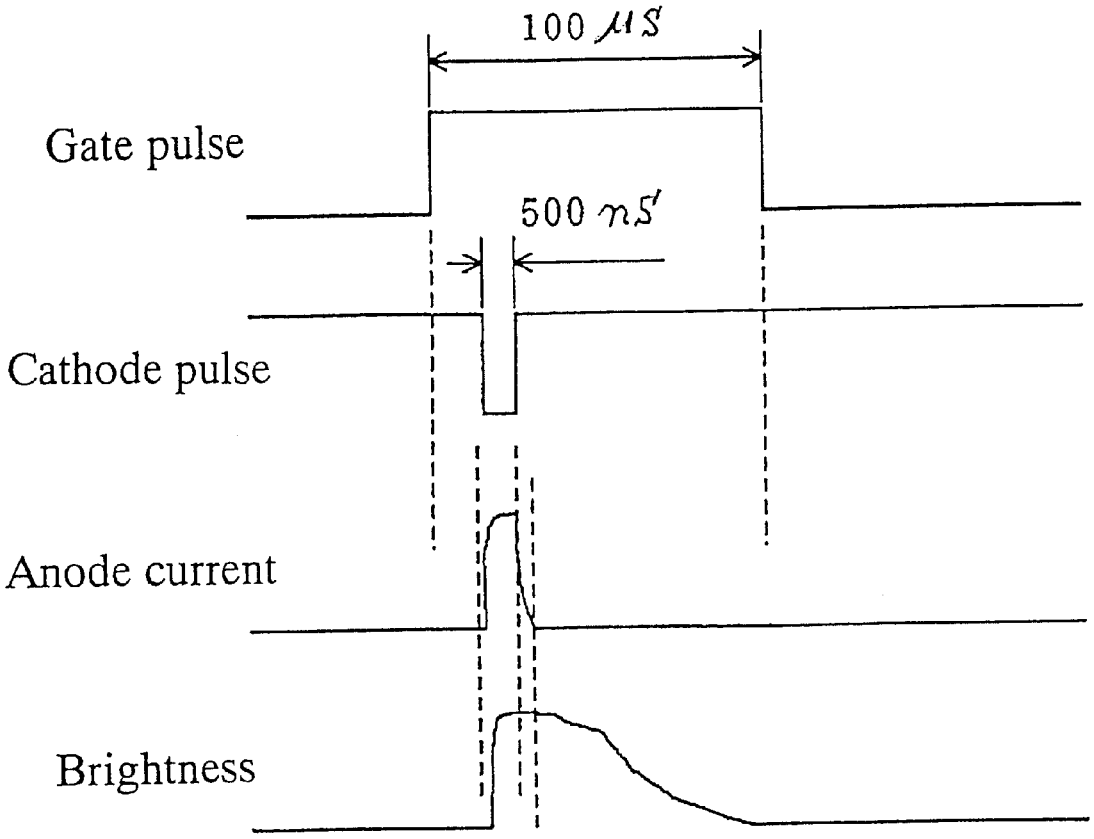
FIG. 13 is a diagram illustrative of driving and output characteristics in the novel driving method for driving the field emission display in a sixth embodiment according to the present invention.

A sixth embodiment according to the present invention will be described in detail with reference to the drawings, wherein a fourth novel driving method of driving a field emission display is provided. FIG. 13 is a diagram illustrative of driving and output characteristics in the novel driving method for driving the field emission display in a sixth embodiment according to the present invention, the gate pulse becomes +10V only in the time period of 100 microseconds and is 0V in the remaining time periods, wherein the rectangle pulse signal is used. In the time period of the positive gate pulse potential level, there is provided a period of the cathode pulse being negative potential, wherein cathode pulse becomes −10V in the 500 nanoseconds time period and is at 0V in the remaining time periods. The characteristics of the anode current and brightness are illustrated in FIG. 13.

In accordance with the novel driving method for driving the field emission display, the current flowing through the fluorescent power source is detected. The detected current value is stored in the frame memory as the information in correspondence with the timing pulse given from the cathode panel driving circuit. The information stored in the frame memory are converted into the display brightness information and the display brightness information are then stored.

In the overlapping time period of the positive gate pulse applied to the gate electrode and the time period of the negative cathode pulse applied to the cathode electrode, electrons are emitted. The measurement result of measuring the fluorescent current of electrons are displayed as the anode current.

A first side of the fluorescent panel is exposed to the vacuum inter-space separating the fluorescent panel from the gate and cathode electrodes. A second side of the fluorescent panel is exposed to the atmosphere. The first side of the fluorescent panel is the high voltage side. The second side of the fluorescent panel is the low voltage side. A delay circuit is provided which comprises interconnections and internal resistances of the power source, wherein the delay circuit provides delays in the fall-edge and the rise-edge. The high voltage of about +5V is applied to the fluorescent panel.

The luminescence form the fluorescent panel is continued due to afterimage and saturation characteristics even after the anode current disappeared as shown in FIG. 13. If the time period of the negative cathode pulse is extended, then the time period of the luminescence is also extended. In FIG. 13, the height of the graph represents the brightness level.

The extension of the time period of the anode current application causes the increase in brightness. The characteristic in increase of the brightness is then subjected to the functional approximation for use in conversion from the measured anode current value into the brightness. These correction data may be used for the actual conversion into the rightness characteristics in the display operation if the frame rate is delayed in obtaining the correction data.

There can be obtained a trilateral-relationship of the luminescent characteristics of the display device, the fluorescent panel application power current and output from the cathode panel driving circuit. By use of the trilateral-relationship, it is possible to realize a highly accurate correction to the output from the driver circuit. The other operations and process than what have been described above are substantially identical with the first novel driving method of the first embodiment.

In accordance with the driving method of driving the field emission display, what is fully intended to be corrected is the luminescence. To correct the output from the driver circuit, the correction information may be processed in the electric signals. This makes it easy to realize the desired corrections. The correction to the output from the cathode panel driving circuit is made based on the current value of the fluorescent power source which is most deeply relative to the luminescent characteristic.

In accordance with the novel driving method, it is intended to finally correct the luminescent characteristic. For this purposes, a relative relationship between the current value of the fluorescent power source and the fluorescent characteristic is verified and corrected in one time period, and further another relative relationship with the current value of the fluorescent power source and the output from the cathode panel driving circuit is verified and corrected in other time period, so that a relationship between the luminescent characteristic and the output from the cathode panel driving circuit is verified and corrected at high accuracy.

Seventh Embodiment

Figure 14:
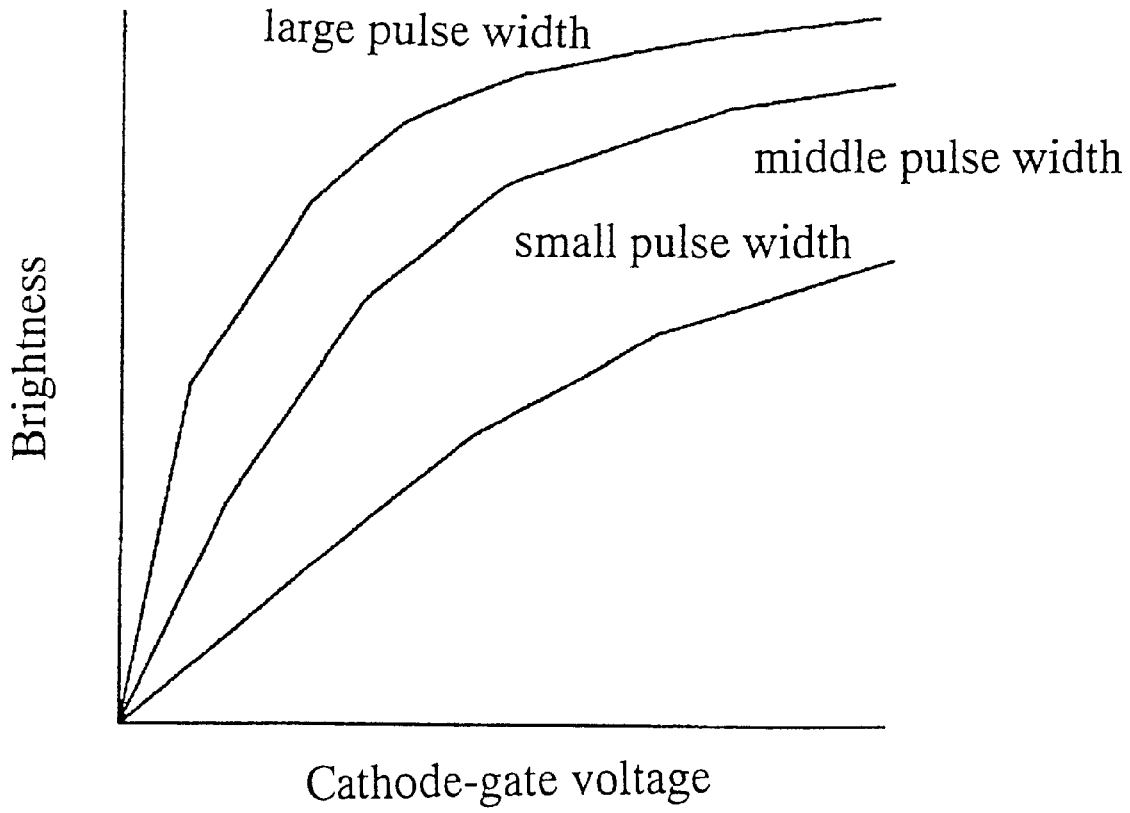
FIG. 14 is a diagram illustrative of relationships of brightness, cathode-gate voltage and pulse width in the novel driving method of driving the field emission display in a seventh embodiment in accordance with the present invention.

A seventh embodiment according to the present invention will be described in detail with reference to the drawings, wherein a fifth novel driving method of driving a field emission display is provided. FIG. 14 is a diagram illustrative of relationships of brightness, cathode-gate voltage and pulse width in the novel driving method of driving the field emission display in a seventh embodiment in accordance with the present invention. The high voltage of +2V is applied to the fluorescent panel. The pulse voltages are applied to 1920 of the cathode line and 480 of the gate line for carrying out the raster scanning from the left top pixel to the right bottom pixel, wherein the pixel emitting electrons is changed sequentially, so that any time, the electrons are emitted from one of the pixels or the electron source units by utilizing an analog modulation. In case of the analog modulation, the voltage to be applied to the cathode material controls the electron emissions. The voltage application time period is constant. Placing the pixel in the electron emission state, the driving operation is so made that the potential difference between the gate electrode and the cathode electrode is 20V. In synchronizing with the raster scanning, the anode current is stored at a corresponding address of the frame memory. Further, the driving operation is so made that the potential difference between the gate electrode and the cathode electrode is 15V. In synchronizing with the raster scanning, the anode current is stored at a corresponding address of the frame memory. Further more, the driving operation is so made that the potential difference between the gate electrode and the cathode electrode is 10V. In synchronizing with the raster scanning, the anode current is stored at a corresponding address of the frame memory. The frame memory is responsible to the above three states. On the basis of the stored data in the frame memory, the relationships shown in FIG. 14 are used for storing the brightness data corresponding to the individual potential differences. The correction to the stored data is made from the differences between the fluorescent voltages of 2 kV and 5 kV, and then corrected data are stored in the frame memory. On the basis of the corrected data, the potential difference corresponding to the necessary brightness is obtained to prepare an available function for the data of the necessary potential difference to obtain the brightness from the selected pixel or electron source unit. On the basis of the above corrected data, the field emission display panel is driven by the high voltage of +5V as the normal potential level to obtain the desired in-plane stable image over the display screen.

The other operations and processes than what have been described above are substantially identical with the above second embodiment.

It is possible as an application to the driving method of driving the field emission display that during the raster scanning operations, both the brightness and the anode current values are measured to store both measured data into the frame memory.

The brightness has the afterimage as shown in FIG. 13, for which reasons the frame rate is lowered to avoid overlap of the electron emissions from the adjacent two of the pixels or the electron source units. The overlap of the electron emissions from the adjacent two of the pixels means that the luminescence appears from the adjacent two of the pixels.

It is also possible to delay the frame rate, for example, at 10 times. The cathode pulse width is modulated in correspondence with the normal image display, whilst the frame rate is delayed. Further, the voltage applied to the fluorescent panel is 1 kV. Data are stored in the frame memory. A relationship between the anode current and the brightness is stored in the form of approximating equation to take individual averages of the red (R), green (G) and blue (B).

The accurate relationship between the anode current and the brightness in correspondence with the red (R), green (G) and blue (B) are obtained. The data are taken one time for every day, so that the data are converted by use of the individual color data. It is possible to take the correction data one time for every day by measuring the fluorescent panel current along or in combination with the brightness measurement.

If the measurement of the fluorescent panel current is made in combination with the brightness measurement, then it is possible to judge whether or not the emitted electrons are accurately irradiated to the target position of the fluorescent material.

In accordance with the method of driving the field emission display, the information about current values are stored in the frame memory and those information are then converted into the display brightness information for subsequent storing the converted information into the frame memory again, so that the different voltage than the normal display case is applied to the fluorescent panel. If the voltage level applied to the fluorescent panel is changed, then the interrelationships for how much to improve the luminescent efficiency have previously been grasped for conversions into the luminescence amount prior to the storing operation into the frame memory.

If the different voltage from the normal display case is applied to the fluorescent panel, then the voltage applied to the fluorescent panel is increased by 1.5 times in the time period of obtaining the correction data, so as to increase the luminescent efficiency of the fluorescent panel. If, in this state, a small current is irradiated to the fluorescent panel in a short time period, then the more bright luminescence than the normal state can be obtained. The luminescence amount is obtained as the display brightness information to realize the highly accurate luminescent characteristics.

The change in voltage level applied to the fluorescent panel causes change in luminescent efficiency. If the interrelationship between the variation in the applied voltage to the fluorescent panel and the variation in the fluorescent efficiency has previously been grasped, it is possible to convert the measured data into the luminescent amount in the normal display state for subsequent storing the converted data into the frame memory. If the voltage level applied to the cathode panel has been set lower than the normal voltage level, then it is possible to prevent the unnecessary luminescence in obtaining the correction data.

In accordance with the above described novel field emission displays and the novel methods of driving the field emission displays, it is possible to obtain the brightness-stable image of the field emission display. In obtaining the correction data, the voltage applied to the fluorescent panel is intentionally reduced to prevent any unnecessary luminescence and also prevent the fluorescent material from avoidable damage. If the voltage applied to the fluorescent panel is increased, then it is possible to improve the accuracy in detecting the light.

If, in obtaining the correction data, the frame rate is delayed, then it is possible to measure the current flowing through the fluorescent power source at a sufficiently high time resolution even a time responsibility of the ampere meter is not superior. If, in obtaining the correction data, the frame rate is accelerated, then it is possible to obtain the correction data in a short time.

If the field emission display is driven so that electrons are not emitted from the plural electron source units concurrently, then the current to be measured by the ampere meter corresponds to the electron emission from one electron source unit. It is, therefore, possible to increase the accuracy in the correction data of the each electron source unit.

If the electrons are emitted from the plural electron source units instantaneously, then in place of the measurement to the luminescent characteristics, the measurement is made to the current for independently obtaining the correction data for each electron source unit. It is also possible to provide a photo-detector to the field emission display for detecting the light for the purpose of improvement in the photo-detecting sensitivity.

Whereas modifications of the present invention will be apparent to a person having ordinary skill in the art, to which the invention pertains, it is to be understood that embodiments as shown and described by way of illustrations are by no means intended to be considered in a limiting sense. Accordingly, it is to be intended to cover by claims all modifications which fall within the spirit and scope of the present invention.

What is claimed is:

1. A field emission display comprising:

a cathode panel having an array of electron source units for emitting electrons;

a fluorescent panel distanced by a vacuum inter-space from said cathode panel;

a cathode panel driver circuit being connected to said field emission display panel for controlling electron emissions from said electron source units;

a fluorescent voltage supplying device being connected to said fluorescent panel for supplying a fluorescent voltage to said fluorescent panel;

a current measuring device being connected to said fluorescent voltage supplying device for measuring a current value of said fluorescent voltage supplying device;

a memory connected to said current measuring device for receiving a measured current value from said current measuring device and storing the measured current value; and a pulse signal converter for transmitting control pulse signals as control signals, said pulse signal converter changing at least one of a pulse height and a pulse width of the control pulse signal on the basis of said measured current value, said pulse signal converter being connected to said memory for receiving the measured current value for correcting said control signals on the basis of comparing said measured current value with a reference current value stored in said memory, and said pulse signal converter also being connected to said cathode panel driver circuit for transmitting said corrected control signals to said cathode panel driver circuit.

2. The field emission display as claimed in claim 1, wherein said pulse signal converter transmits a timing pulse to said memory, and said memory stores said measured current value as an information in correspondence with said timing pulse, and said memory transmits said measured current value as a correction data to said pulse signal converter.

3. The field emission display as claimed in claim 2, wherein said fluorescent voltage supplying device reduces a voltage level of said fluorescent voltage to be supplied to said fluorescent panel, when storing said measured current value into said memory as said information in correspondence with said timing pulse.

4. The field emission display as claimed in claim 2, wherein said cathode panel driver circuit drives said cathode panel under said control pulse signal so that electrons are emitted from any one of said electron source units at anytime, when storing said measured current value into said memory as said information in correspondence with said timing pulse.

5. The field emission display as claimed in claim 2, wherein said cathode panel driver circuit drives said cathode panel under said control pulse signal in a different frame rate from a normal frame rate, when storing said measured current value into said memory as said information in correspondence with said timing pulse.

6. The field emission display as claimed in claim 2, further comprising a brightness converter connected to said memory for converting said measured current value into a brightness data for subsequent storing said brightness data again in said memory, so that said memory transmits said converted brightness data to said pulse signal converter as said correction data.

7. The field emission display as claimed in claim 6, wherein said cathode panel driver circuit drives said cathode panel under said control pulse signal in a different frame rate from a normal frame rate, when storing said brightness data again in said memory.

8. The field emission display as claimed in claim 1, further comprising a photo-detector provided at an edge of said fluorescent panel.

9. The field emission display as claimed in claim 1, wherein said current measuring device comprises an ampere meter connected to a lower voltage side of said fluorescent voltage supplying device.

10. A method of driving a field emission display comprising: a cathode panel having an array of electron source units for emitting electrons; a fluorescent panel distanced by a vacuum inter-space from said cathode panel; a cathode panel driver circuit being connected to said field emission display panel for controlling electron emissions from said electron source units; a fluorescent voltage supplying device being connected to said fluorescent panel for supplying a fluorescent voltage to said fluorescent panel; a current measuring device being connected to said fluorescent voltage supplying device; a memory connected to said current measuring device; and a pulse signal converter for transmitting control pulse signals as control signals, and changing at least one of a pulse height and a pulse width of the control pulse signal on the basis of said measured current value, said pulse signal converter being connected to said memory, said method comprising the steps of:

measuring a current value of said fluorescent voltage supplying device by said current measuring device;

storing a measured current value from said current measuring device into said memory; and correcting said control signals by said pulse signal converter on the basis of comparing said measured current value to a reference current value stored in the memory, and transmitting said corrected control signals to said cathode panel driver circuit.

11. The method as claimed in claim 10, wherein a timing pulse is transmitted from said pulse signal converter to said memory for storing said measured current value as an information in correspondence with said timing pulse, and said measured current value as a correction data is transmitted from said memory to said pulse signal converter.

12. The method as claimed in claim 11, wherein said fluorescent voltage supplying device reduces a voltage level of said fluorescent voltage to be supplied to said fluorescent panel, when storing said measured current value into said memory as said information in correspondence with said timing pulse.

13. The method as claimed in claim 11, wherein said cathode panel driver circuit drives said cathode panel under said control pulse signal so that electrons are emitted from any one of said electron source units at anytime, when storing said measured current value into said memory as said information in correspondence with said timing pulse.

14. The method as claimed in claim 11, wherein said cathode panel driver circuit drives said cathode panel under said control pulse signal in a different frame rate from a normal frame rate, when storing said measured current value into said memory as said information in correspondence with said timing pulse.

15. The method as claimed in claim 11, further comprising the steps of converting said measured current value into a brightness data for subsequent storing said brightness data again in said memory, so that said memory transmits said converted brightness data to said pulse signal converter as said correction data.

16. The method as claimed in claim 15, wherein said cathode panel driver circuit drives said cathode panel under said control pulse signal in a different frame rate from a normal frame rate, when storing said brightness data again in said memory.

* * * * *